US005205354A

United States Patent [19]

Lesage

[11] Patent Number: 5,205,354

[45] Date of Patent: Apr. 27, 1993

[54] VEHICLE RADIATOR AND METHOD OF MAKING

[76] Inventor: Philip G. Lesage, 7835 Highway 50, Unit 8, Box B-1, Woodbridge, Ontario, Canada, L4L 1A8

[21] Appl. No.: 826,788

[22] Filed: Jan. 28, 1992

[51] Int. Cl.[5] ..... F28F 9/06

[52] U.S. Cl. ..... 165/173; 165/83; 165/149

[58] Field of Search ..... 165/82, 83, 149, 173

[56] References Cited

U.S. PATENT DOCUMENTS

| | | | |
|---|---|---|---|
| 1,781,511 | 11/1930 | Hawkins | 165/149 |
| 1,899,629 | 2/1933 | Morse | 165/149 X |
| 2,178,095 | 10/1939 | Bowser | 165/149 X |
| 2,505,790 | 5/1950 | Panthofer | 165/149 X |
| 3,113,615 | 12/1963 | Huggins | 165/149 |
| 4,125,280 | 11/1978 | Kuzel | 285/137 R |
| 4,236,577 | 12/1980 | Neudeck | 165/175 |
| 4,382,464 | 5/1983 | Melnyk | 165/76 |
| 4,756,361 | 7/1988 | Lesage | 165/149 |
| 5,052,475 | 10/1991 | Grundy | 165/76 |

FOREIGN PATENT DOCUMENTS

| | | | |
|---|---|---|---|
| 371532 | 6/1990 | European Pat. Off. | 165/173 |
| 2082312A | 3/1982 | United Kingdom | 165/173 |

*Primary Examiner*—Allen J. Flanigan

[57] ABSTRACT

A radiator core is combined with upper and lower tanks which tanks are each a welded combination of tube walls and a header plate which receives the tubes of the radiator core.

8 Claims, 4 Drawing Sheets

Figure 3:
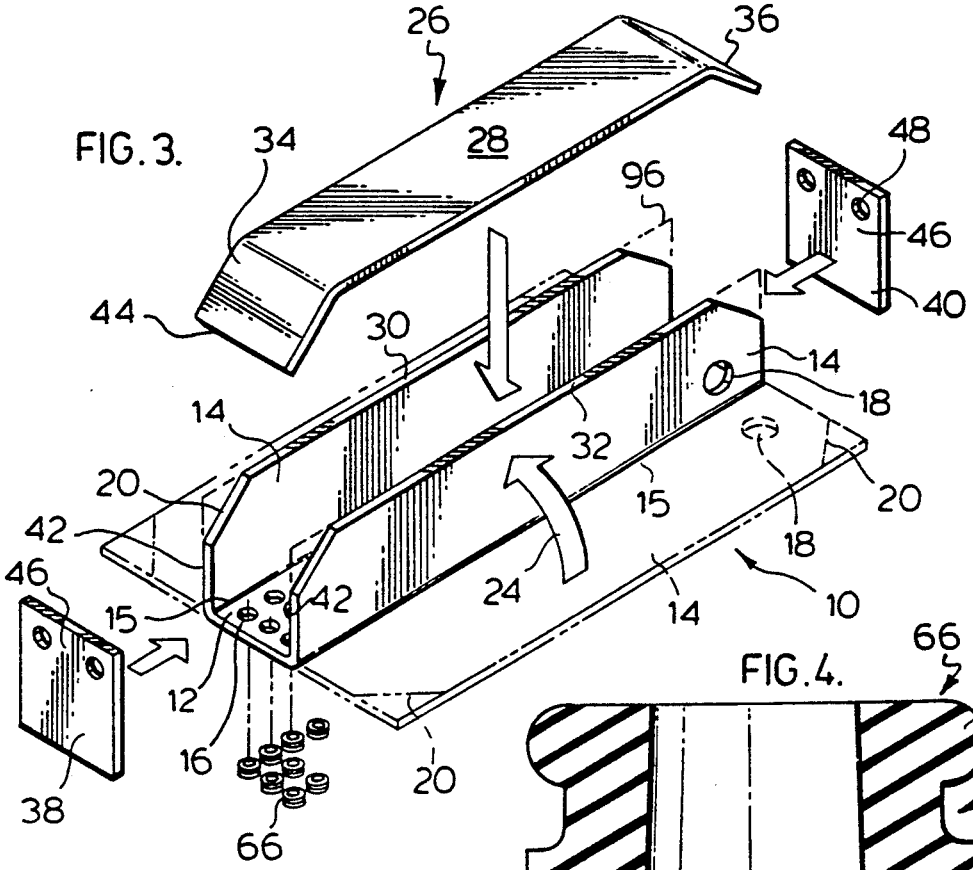

FIG.1.
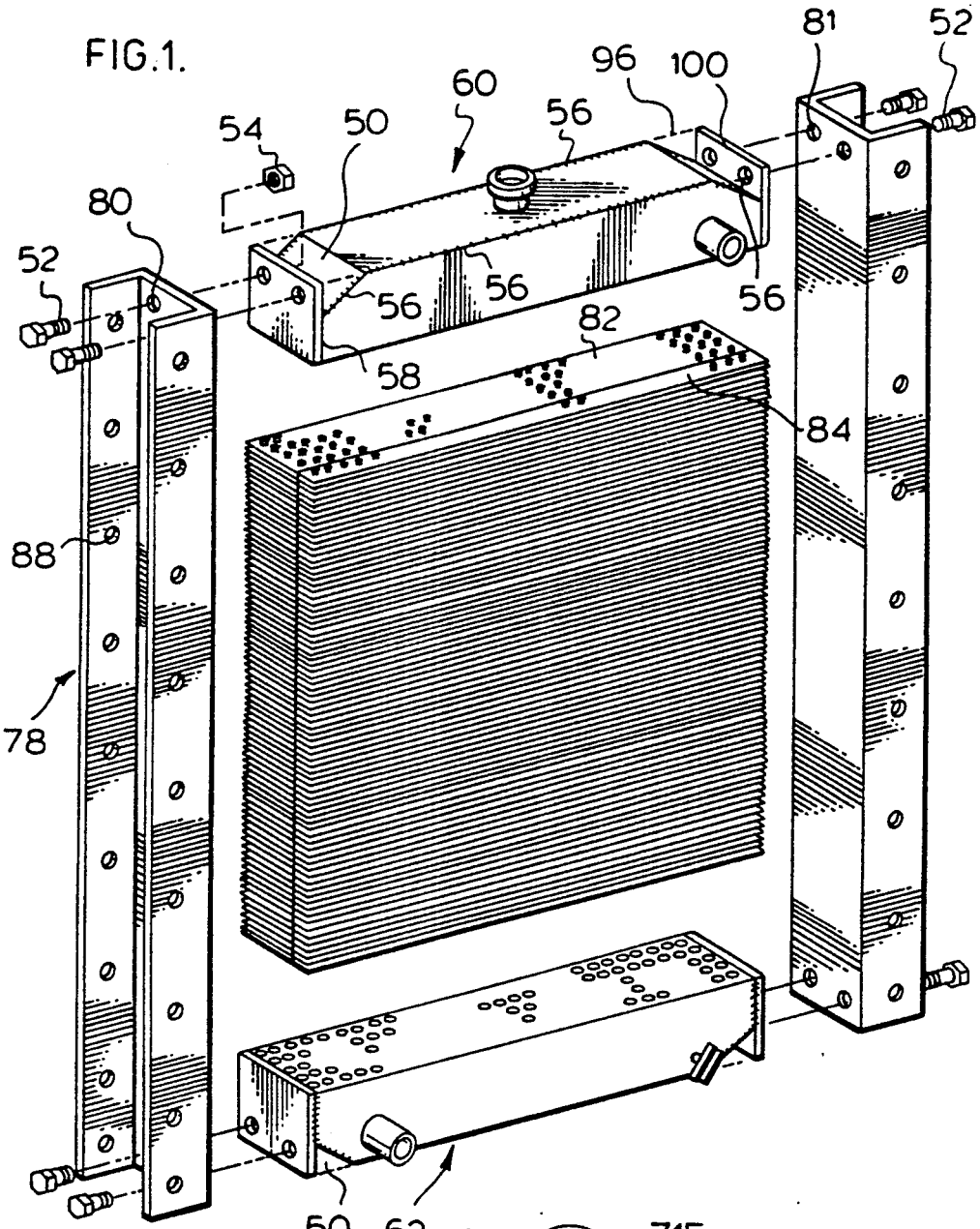
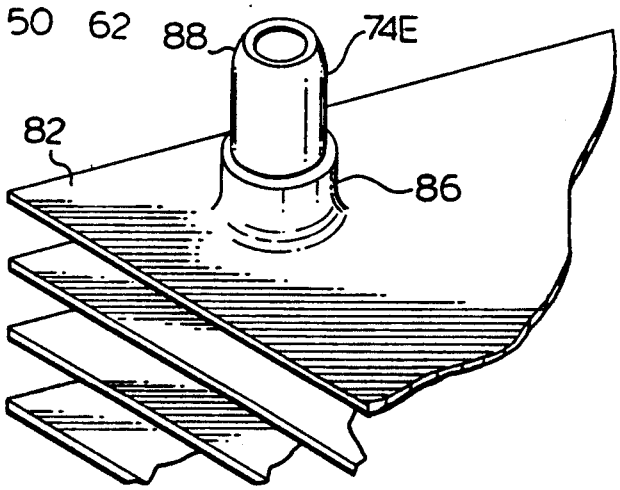
FIG.2.

VEHICLE RADIATOR AND METHOD OF MAKING

This invention relates to a novel combined tank and header plate for radiator cores, a novel method of making such a combined tank and plate, a novel radiator using the combined tank and header plate and a novel method of making said radiator.

The art to which the invention relates is that of radiators designed principally for installation at the front of a truck or other vehicle for cooling the coolant fluid of the engine. The radiators with which the invention is concerned comprise a core, upper and lower tanks and members joining the upper and lower tanks to provide the necessary structural strength for the radiator during use. The terms 'upper' and 'lower' herein refer to a common orientation for the radiator but are not intended to be limiting in either the disclosure or claims since the radiator may have any orientation. The structural members preferably connect to the upper and lower tanks at connections exterior to the tanks and to the core. The core with which the invention is concerned is composed of generally parallel tubes for carrying coolant fluid, linked by cooling fins, extending transverse to the core. The core alone preferably forms a self-sustaining assembly before the radiator is assembled although such assembly, even if self-sustaining, will require structural support during use in the radiator. The core with which the invention is concerned provides upper and lower tube ends projecting above and below, respectively, the uppermost and lowermost transverse fins. Upper and lower header plates are each apertured to receive the tube ends and designed with the tubes, to make sealing connection therewith. The header plates may, in prior designs alternatively, be considered as part of the core or as the core-adjacent walls of the upper and lower tank. Applicant's U.S. Pat. No. 4,756,361 ('361 hereafter) dated Jul. 12, 1988 and entitled Radiator Core shows a radiator core of which the header plate forms a part. The disclosure of such patent is included herein by reference. However in patent '361 the header plate is first attached to the core before attachment to the side walls and core remote wall of the tank. In accord with this invention a header plate is first attached to the side and core-remote walls of the tank to form a combined tank and header plate before attachment of the core to the header plate.

As in patent '361 the preferred header plate in this invention is apertured to receive the adjacent tube ends. In accordance with an important aspect of the invention, a resilient centrally apertured grommet is placed in each header plate aperture and dimensioned together with the header aperture so that the grommet is compressed on tube insertion to provide good sealing between the grommet and the tube outside walls and between an outer surface of the grommet and the header plate. The sealed arrangement thus provided leaves the tube in communication with the inside of the header tank.

It should be noted that in the broader aspects of the invention the welded combined tank and header plate may be combined with a wide variety of cores, not limited to the type of patent '361 and the sealing of tank and tube will be determined by the type of core and header plate used. It should be noted that the core preferred is that of patent '361 and the sealing of tubes to header plates is preferably performed using the resilient grommets described in patent '361. However where grommets are used, the header plates, apertures and grommets need not be circular, in distinction to patent '361 although the round shape is preferred. The grommets preferred herein have a more rounded contour on the interior side than those shown in patent '361 to facilitate their insertion in header plate apertures from the outside of a completed tank.

In accord with the method of the invention, the upper and lower tanks are formed of blanks which are welded together to form a sub-assembly being the side and core-remote walls of a tank and which define an opening facing the intended assembly direction of the core. The necessary fittings and connections may then be welded to the sub-assembly with outside welds. The term 'side walls' includes either the longer side walls or sides and the shorter side walls or ends. The core-remote wall may have a defined division from the side walls or both may be part of a continually curving surface. The term 'sub-assembly' is not intended to imply an order to the welding processes used herein. Thus where the sub-assembly is composed of welded panels it is not necessary that the sub-assembly welding be complete before the header plate is welded to the side walls. Alternatively the side wall panels or some of them could be welded to the header plate before the core-remote wall or other walls are welded to side panels. The welds should be on the outside of the tank to permit easy welding repair of leaks.

In the broad aspects of the inventive method the apertured header plates are selected for sealing connection to the tubes of the radiator core, so that the outside of the tube may later be sealed to the header plate while the inside of the tube will at that time be in communication with the inside of the tank. The header plate thus selected is welded to the side walls of the sub-assembly to form, with the side assembly a combined tank and header plate.

After welding is completed, in upper and lower combined tanks and header plates, the tanks are assembled above and below the core with the outsides of the tubes sealed to the header plates and the insides of the tube in communication with the insides of the tanks.

In a preferred aspect of the inventive method the core is formed in accord with patent '361. A header plate is provided designed to receive grommets as described in patent '361 although the preferred grommet shape shown herein is an improvement over that shown in patent '361. In distinction to patent '361 however the header plate is herein welded to the tank side walls before assembly to the core and before insertion of the grommets. In accord with the preferred method of the invention, after the welding is complete the grommets are inserted in the header plate apertures and the tanks are assembled to the core by inserting the tubes in the grommets of the upper and lower tanks. The grommets are dimensioned to be compressed and sealed to the header plates and sealed to the tubes. The assembled tanks and core are provided with means connecting the upper and lower tanks to rigidify the radiator. The core before assembly is preferably a self-sustaining unit although it requires structural support in use. Side members are attached to Join the upper and lower tanks to provide the structural rigidity for the radiator and the core.

In U.K. patent 29,777 of W. S. Tyler dated 27 DEC 12 a radiator is disclosed wherein the upper and lower tanks are provided with grommets for sealing relationship with individual tubes bowed and inserted in the grommets to extend between the upper and lower tanks. However the upper and lower tanks are cast which would be a practical impossibility since each tank model would require a separate mold and a manufacturer or repair shop of modest size would have to have about 150 different molds to provide radiators or replace tanks for current vehicle models. Moreover the tubes are not interconnected by fins and require individual installation. The individually replaceable tubes would render repair of the Tyler unit impractical. Further the fins and tubes do not exist as a separate core unit. By contrast; in the inventive method, the tanks and header pate are easily formed and welded as a unit and the change of dimensions from one model to the next is easily taken into account when the sub-assembly or header plate blanks are stamped and the blank production is amenable to computer assisted manufacturing techniques. Moreover the core comprising vertical tubes with horizontal fins joining them may be prefabricated as a separate assembly as taught in patent '361 for assembly with the upper and lower tanks and side rails as when required.

The inventive method may further be contrasted with some present methods of fabricating tanks which stamp the shape of the core-remote and side walls. Here again such present methods would require about 150 stamping forms. Moreover the preferred inventive method using the grommets for sealing avoids the complexity and size increase caused by the present methods which attach the header plate by a bolt, and gasket or soldered construction.

In an alternative aspect of the inventive method a vehicle having a damaged radiator core but upper and lower tanks may have its radiator replaced by cutting off the tanks adjacent the header wall, providing header plates of the first type described in patent '361 first welding the header plates to the tanks, inserting grommets and assemble the combined tanks and header plates thus formed with a core.

In accord with another aspect of the invention the invention provides a sub-assemblies of welded blanks forming the side and core remote walls of a tank, welded to a header plate to which grommets may be applied which may be fitted to the tube ends at each end of the core.

In accord with the invention there is provided a combined radiator tank and header plate comprising the side and core-remote walls of a pre-existing radiator welded to a header plate designed to receive grommets for, in turn, receipt of the tubes of the pre-assembled core.

In accord with the matters discussed above the objects and consequent advantages include:

It is an object of the invention to provide a combined tank and header plate and a radiator made therefrom and method of making the combination and the radiator, which are economical and convenient to manufacture.

It is an object of the invention to provide a combined tank and header plate and a radiator made therefrom and method of making which allows for use where size restrictions inhibit contemporary bolt and gasket techniques for joining the header plate to the tank.

It is an object of the invention to provide a radiator and method, of construction which is readily disassembled for core repair or cleaning.

It is an object of the invention to provide a combined tank and header plate, radiator made therefrom and method of making which allow the use of the side and core-remote walls of a pre-existing tank to be used with a welded to a header plate as described.

It is an object of this invention to provide a combined tank and header plate with a simplified construction which eleminates the use of soldered Joints or bolt and gasket construction.

The combined tank and header plate may be constructed of any weldable metal but will usually be of steel, brass or aluminum. It is understood that members to be welded together must both be of the same metal.

Other advantages and features of the invention will be described in connection with the specific embodiment.

Figure 4:
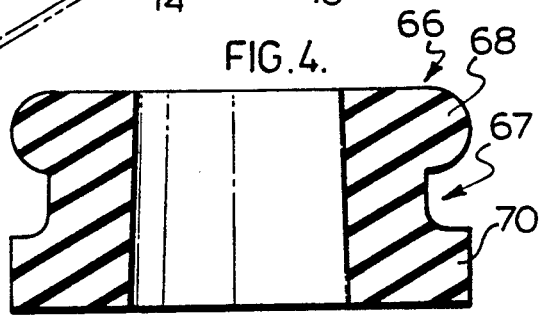
Figure 5:
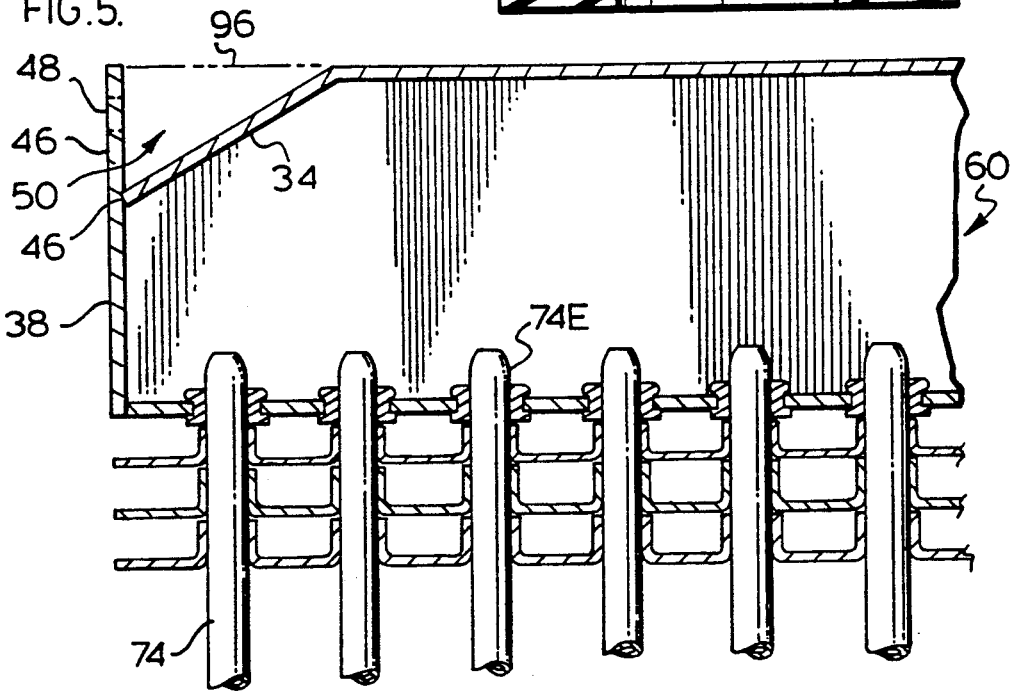
Figure 6:
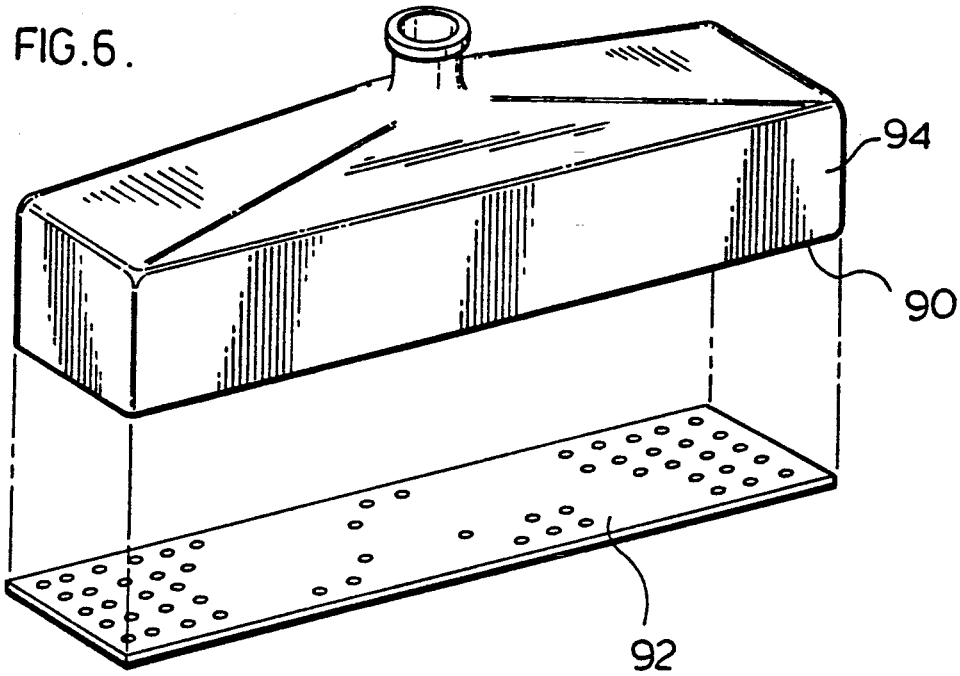
Figure 7:
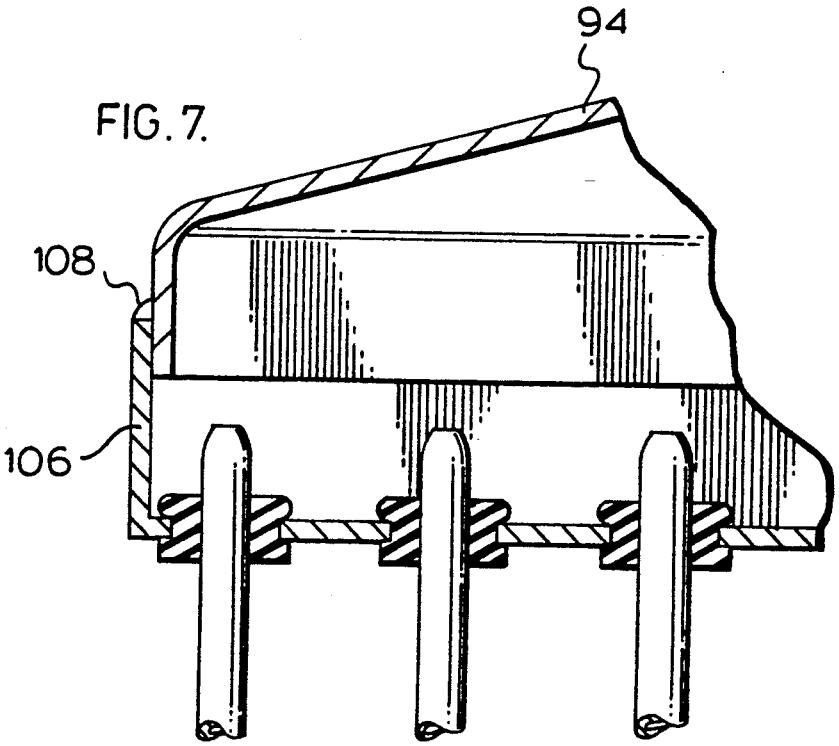
Figure 8:
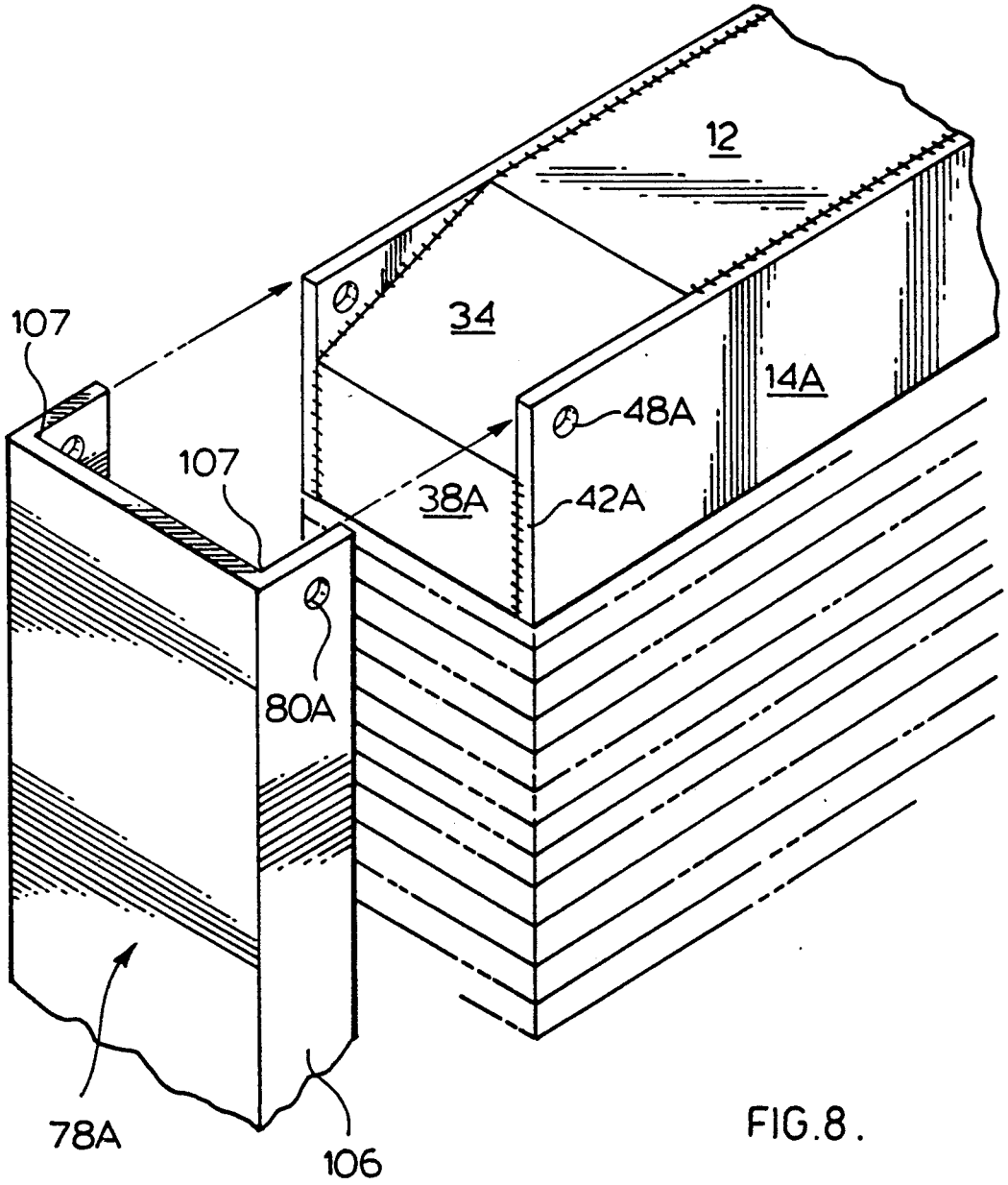

In drawings which illustrate a preferred embodiment of the invention,

FIG. 1 is an exploded assembly drawing of a radiator in accord with the invention, FIG. 2 is an enlarged view of an element in FIG. 1, FIG. 3 is an exploded view demonstrating the fabrication of a combined tank and header plate, FIG. 4 is a sectional view of a grommet in accord with the invention, FIG. 5 is a partial section of the assembled core and tank, FIG. 6 is an exploded view demonstrating the formation of a combined tank and header plate using a subassembly from a pre-existing tank, FIG. 7 shows use of a special header plate in cooperation with a sub-assembly from a pre-existing tank, FIG. 8 shows an alternate side rail arrangement.

In the drawings FIG. 3 shows a blank 10 which is stamped to provide panels for a header plate 12 and the longer side walls 14 of a radiator tank. The header plate will be stamped with apertures 16 to accept grommets, (as hereafter described and as described in patent '361), apertures 18 for such fittings as hose connections and end flanges. Apertures 16 will be arranged in an array to correspond to the tube arrangement in the core. The blank's dimensions and the location and dimensions of the apertures may conveniently be provided by automated machinery under computer numerical control ('CNC') and generally in accord with computer assisted manufacture ('CAM') or design ('CAD').

As shown in solid lines 20 the corners of the blank are preferably cut along diagonals relative to the length and width axes of the blank 10 and for a purpose to be hereafter discussed.

The blank 10 comprises the header plate 12 (centrally) and, on each side, side walls 14 which are folded as indicated by arrow 24 to form the longer side walls of the combined tank and header plate. The folding may be performed by conventional machinery well known to those skilled in the art.

A blank 26 is provided with a central panel 28 of length corresponding to the longitudinally extending edges 30 and 32 of sides 14 and a width corresponding to the distance between said edges 30 and 32 in the folded position of blank 10. Blank 26 provides outer panels 34 and 36 of common width with panel 28 and length corresponding to the diagonals 20 of blank 10.

The blank 26 is then folded by conventional machinery to, the form shown in FIG. 3 conform to the upper (in folded form) edges 30 and 32 of the walls 14. Any necessary fittings and connections may then be welded to the folded blank 10 with outside welds.

End plates 38 and 40 are designed to form the short side walls of the tank to extend between side wall end edges 42 and extends upwardly above the end edge 44 of the walls 14 and end edge 44 to form a panel 46.

The upper panel 46 of the end plates 38 is provided with end apertures 48 for a purpose to be described hereafter. The sloping edges of the top wall and the upstanding panel 48 of the end plates form a niche 50 to receive bolts 52 (FIG. 1) extending through hole 48 and the nuts 54 on the inner end.

Thus the folded form of the header plate 12 and longer side walls 14 is welded with outside welds 56 to the top plate and the end plates welded in place with outside welds 58. There is thus shown a combined upper header plate and tank 60. Lower header plate and tank 62 is formed in a similar in manner and is usually identical to tank 60.

All welding in the fabrication of the tank is performed before the grommets are inserted. The preferred arrangement of having a blank comprising the header plate 16 between the two longer side walls 14 provides rigidity along the folded lines 15 both before and after welding to the other tank components. Moreover the (outside) welding 56 along edges 30, 32 at the maximum distance from the grommets 66. Thus if leaks develop in this area in a fabricated radiator in use, remedial exterior welding to stop the leaks is at the maximum distance from the (relatively) heat sensitive grommets, avoiding damage to the grommets.

Although the blank arrangement shown is preferred the sub-assembly (within the broad scope of the invention, may be made up of exteriorly welded blanks as desired. Or the header plated may be exteriorly welded to one or more blanks making up part of the sub-assembly before the exterior welding thereto of the blanks of the sub-assembly.

The lower tank will be formed in the same manner as the upper and preferably is identical thereto. Grommets 64 are provided for insertion in the apertures of the header plates.

The resilient grommet 66 is shown in FIG. 4 which is a section along the axis of revolution of the grommet which is a surface of revolution. As shown, the grommet defines a groove 67 dimensioned to receive the aperture 16 defining edges of header plate 12. The relative dimensions are such that the grommet when installed will press on each side of plate 12. The groove 67 is defined by upper lip 68 and lower lip 70. The lower lip 70 is nearly rectilinear in section with a slight fairing to the root of the groove. The upper lip 68 is rounded at the outside to be almost semicircular in section. This may be compared with the grommets shown in patent '361. In the patent '361 both upper and lower lips are rectilinear in section. This former grommet shape although useful before and useful with this invention, has some tendency to tear on insertion and is more difficult to use where all the work of insertion must be done from one side of the header plate as with this invention. Thus the grommet with the rounded upper lip 68 is preferred. The 'upper' lip 68 of course becomes the lower for insertion downwardly into the header plate of the lower tank.

The grommets 66 are dimensioned, in relation to the diameters of the apertures 16 and of the core tubes 74 so that, with the grommet in the aperture and the tube 74 passing through the aperture in the grommet, the grommet is compressed between the aperture defining edges of header plate 12 and the outside surfaces of tubes 74 to seal with both header plate 12 and tubes 74.

Preferably this is achieved by making the unstressed diameter of the root of groove 67 slightly larger than the diameter of the header plate aperture and the unstressed diameter of the groove aperture slightly smaller than the exterior diameter of a tube 74.

The grommets 66 are of resilient material selected to maintain the resiliency and strength of the grommets under the necessary condition of heat and cold which will be encountered by the radiator in use. It is preferred to use silicone and of the silicone materials available I prefer to use 60 Durometer manufactured by Freudenberg-NOK Inc. P.O. Box 100, 65 Spruce St., Tillsonburg Ont. CANADA N4G 4H3. The choice of grommet qualities is constrained to materials yieldable enough to allow tube insertion and resilient enough to seal against the tube walls and header plate edges. Silicone is very much preferred to rubber which is much more subject to deterioration and cracking under the range of temperature conditions. The grommets 66 are preferably made in the form of a surface of revolution where the apertures 16 are circular.

Grommets 66 are preferably constructed so that the groove 67 is slightly narrower than the thickness of the header plate 12. The result is that when the grommet is first inserted in an aperture 16 it is slightly concave upward and downward. These concavities tend to become flat when the tube is inserted. This does not materially affect the sealing which is principally between the aperture defining edges of the header plate and the root of the groove.

After completion of the fabrication of the tanks, 60 and 62 the grommets 66 are pressed into place in the header plate apertures, from the outside of the tank, with the rounded (section) lip 68 entering the tank for cooperation with the inside surface of the header tank and the rectilinear (section) lip 70 resting on the outside surface of the plate.

Side rails 78 are rectangular U shaped channels apertured at 80 top and bottom for bolting by bolts 52 to the upper and lower tanks after assembly of the core, a bolt 52 passing through an aperture 80 and than aperture 48 of a welded tank.

The construction of the core will not be described in detail but reference may be made to Patent '361 for a full description.

Briefly the core comprises an array of vertically extending tubes 74 of thermal conducting material, preferably: copper, brass, aluminum or steel and fins 82 or 84 which extend between the tubes and transversely thereto. I prefer to have each fin extend the width of the core but they may encompass a number of rows from front to tear. In the embodiment shown, copper fins 82 encompass the rearward four transverse rows of tubes 74. Steel fins 84 extend across the forward row of tubes. The steel fins are less efficient in their cooling function but are much stronger and harder than the copper fins and protect the latter from flying stone or other particles in use of the radiator on a vehicle.

As described in patent '361 the fins are apertured to slidably receive the tubes. In stamping the apertures upwardly standing collars 86 are provided. The collars 86 act as spacers between the fins.

Again, as described in patent '361, for core assembly the fins are arranged in a rack or stand in the desired relationship for the core. The tubes are then slid through the fins to their desired positions with tube ends 74E projecting above and below the uppermost and lowermost fins, respectively. With fins and tubes in place, tools, described in patent '361 are used to expand the tubes into functional engagement with the fins and thermal connection with the fin apertures and collars. The core is now, preferably, a (frail) self supporting assembly for connection to the tanks. Although self supporting for assembly purposes the core must be supported in actual use—as hereinafter described, by a frame comprising the upper and lower tanks 60 and 62 and side rails 78.

With supporting means which are conventional and well known to those skilled in the art, the lower tank 62 is maintained in place. The tube ends 74E will have been peened in as shown at 88 to taper slightly for ease of insertion in the fins. The tube ends 74E for ease of insertion in the grommets 66 are first covered with a lubricant (for example liquid dish-washing detergent) then pressed into the lower header plate grommets 60 preferably until the lower fin 82 or 84 contacts the grommet. The resilient grommet is dimensioned to be compressed between the tube and the aperture edges to make a good seal with the exterior tube and with the header plate. It is noted that the inside of the tube is now in communication with the inside of the tank.

The core, with lower tube ends 74E inserted in the lower header plate is supported on any of a number of conventional manners while the upper tank and header plate is lowered over the upwardly extending tube ends 74E lubricated and dimensioned to form with the grommets 66 a seal as discussed in connection with the assembly of the core to the lower tank and header plate.

With upper and lower tanks connected to the header plate, the three elements are supported in any conventional manner while the side frames 78 are bolted in place. A rigid structure is then formed. The holes 88 on the uprights of the U-shaped side rails are then used for mounting the radiator in a vehicle and the connections made to the upper and lower tanks.

There is thus provided a combined radiator tank and header plate which is easily fabricated to 150 or more combinations of height depth and width dimensions, which is easily assembled and dissassembled to the core and side rails and which with its combined tank and header plate and grommets dispenses in two ways with the soldered or bolt and gasket. assemblies of the prior art. Firstly the arrangement dispenses with soldering of the tube exterior to the header plate (as discussed in patent '361). Secondly soldering or gaskets is dispensed with between header plate and tank side walls as disclosed herein.

The tank side and top walls may be assembled with welded panels in a different configuration than that shown. However the preferred arrangement which provide the longer side walls in a single blank with the header plate and folded upwardly therefrom, has advantages. The weld line is necessarily along the upper edges of the longer side walls, well spaced from the grommets on the header plate. Thus in case of leaks, occurring during fabrication, the exterior welds may be perfected, sufficiently far from the grommets to avoid damage from the heat. The arrangement described also provides fold lines 15 on the blank, running in the long dimension of the member to supply structural stability prior to and after the welding into a tank.

Another aspect of the invention is the provision of upper and lower combined tanks and header plates in repair of existing tanks (FIG. 6). The existing tanks are detached from the vehicle and cut at line 90 at a location conform to the selected dimensions of the core.

A header plate 92 similar to panel 12 is welded from the outside to each of the upper and lower tanks (only the upper tank 94 is shown) thus forming a combination tank and header plate from the side and core-remote walls of an existing tank 94 and a new header plate 92.

After, the welding of the upper and lower combined tanks and header plates is completed grommets 66 are inserted round lip first in the header plate apertures as previously described.

The upper and lower tanks assembled to the core as previously described in connection with the embodiment of FIGS. 1-5. Side frames joining the upper and lower tanks in a rigid structure may be provided of a character determined by the prior tank structure of the vehicle being repaired. In this aspect of the invention it will be noted that there is some flexibility in vertical dimension. Thus given the dimensions of the pre-existing tank, the core and two tank heights provided must combine to total the available height for the particular vehicle. However the tanks may be cut deeper or shallower and the core made taller or shorter within the available height limits and designed to provide the desired relation the volume of the tanks and the height of the core.

FIG. 8 shows an alternative form of the invention where the side plates 14A have right angled corners in distinction to edges 20 of FIG. 3. The side plates 14A where they overlap niche 50 above wall 34 are provided with apertures 48A. Side rails 78A are again of rectilinear cross-section but the rails are dimensioned to slide over the side walls 14A of the tank. The uprights 106 are provided with apertures 80A so that attaching bolts may be inserted through apertures 80A and 48A with nuts to bolt the members together. Apertures 80A and 48 are located so that end edges 42A of walls 14A are 'snug' to the inside corners 107 to form a rigid structure when the bolting is complete. End wall 38A may in this alternative be welded between walls 14A.

As with the embodiment of FIGS. 1-5 the panels of the tank and the header plate are first welded with outside welds. The lower tank is similiarly constructed. Grommets are then placed in the header plate apertures. The upper and lower tanks are then bolted in place.

There is minimal width advantage by reversing the channel from its orientation shown in FIG. 1 since although the core may be made wider, the outer areas of the core will be covered by the side panels of the side rails.

In FIG. 7 there is shown a header plate 104 with welded peripheral side walls 106 for welding to a pre-existing tank 94. Although only a shorter side wall 106 is shown similar peripheral longer side walls are provided and welded to the tank 94 at exterior welds 108.

All embodiments described assume a circular core tube in a grommet which is a surface of revolution in turn in circular apertures on a header plate. However the invention, in its broad aspects, may be used with a core having (as known in the prior art) eliptical or oval tubes or tube ends. The header apertures of a combined tank and header plate in accord with the invention are similarly shaped as will be the grommets which may be molded to the desired shape, while maintaining the outward groove and dimensioned to compress in use to seal to the header plate and to the tube exterior.

Without intending to limit the scope of the invention I prefer to construct the combined tank and header plate of steel for economy and I have used steel thickness of between 0.119" and 0.134". Other weldable metals may obviously be used at an added cost. For example where, in accord with the alternative schematically demonstrated in FIG. 6, the existing tank was brass, I have welded thereto a brass header plate 92 of thickness 0.060".

We claim:

1. In combination, radiator core and upper and lower header tanks for assembly thereto, wherein:

said radiator core comprises generally parallel open ended tubes and fins extending from said tubes, a header plate is adapted to seal to side walls of said header tanks and is apertured to receive resilient grommets which in turn receive the ends of said tubes, whereby a seal is established between said header plate and said grommets and between said grommets and said tubes, characterized in that:

each said header tank comprises opposed longer side walls, opposed shorter side walls and a core remote wall wherein each said longer side wall is sealed to each adjacent shorter side walls by welds, wherein said header plate and longer side walls are formed from a unitary metal sheet, and said header plate is sealed to the shorter side walls by welds.

2. In combination, as claimed in claim 1, wherein said welds are exterior relative to said tank.

3. In combination, as claimed in claim 2, wherein said header plate and longer side walls are bent from a unitary metal sheet.

4. In combination, a radiator core and upper and lower header tanks for assembly thereto, wherein:

said radiator core comprises generally parallel open ended tubes and fins extending from said tubes, a header plate is adapted to seal to side walls of said header tanks and is apertured to receive resilient grommets which in turn receive the ends of said tubes, whereby a seal is established between said header plate and said grommets and between said grommets and said tubes.

characterized in that:

each said header tank comprises opposed longer side walls, opposed shorter side walls and a core remote wall wherein each said longer side walls is sealed to each adjacent shorter side wall by welds, wherein said header plate and longer side walls re bent from a single sheet, and said header plate is sealed to the side walls by welds, wherein said core remote wall is unitary metal sheet bent to form a central panel and end panels sloping outwardly and downwardly.

5. In combination, a radiator core and upper and lower header tanks for assembly thereto, wherein:

said radiator core comprises generally parallel open ended tubes and fins extending from said tubes, a header plate is adapted to seal to side walls of said header tanks and is apertured to receive resilient grommets which in turn receive the ends of said tubes, whereby a seal is established between said header plate and said grommets and between said grommets and said tubes.

characterized in that:

each said header tank comprises opposed longer side walls, opposed shorter side walls and a core remote wall wherein each said longer side wall is sealed to each adjacent shorter side walls by welds, and said header plate is secured to the shorter side walls by welds, wherein said grommets each define a side and an end to end central aperture, said side comprising peripheral outstanding lips spaced by a groove adapted to receive the edge of said header plate, each said grommet defining a lip having in side view rounded outside contours on one side of said groove and substantially rectilinear contours on the other side of said groove.

6. In combination:

a radiator core comprising generally parallel open-ended tubes and fins extending transversely relative to said tubes, metal sub-assemblies for forming upper and lower tanks each including core-remote walls and side walls, a pair of header plates corresponding to said upper and lower tanks provided with an array of apertures corresponding to said tubes, welded to the respective sub-assembly to form the core-adjacent wall of the respective tank, said header plate being formed of the same metal as said side walls, said tubes being so attached to said header plates to establish communication for liquid flow between the inside of said tubes and the inside of said tanks and the walls of said tubes are sealed to the walls of said tanks, including a core where the tube ends project beyond the nearest fin, resilient grommets mounted in said header plate apertures adapted to provide a seal between the outside of the grommets and said header plate, said grommets being provided with a central aperture for receiving said tubes and being adapted to seal to the walls of said tubes, wherein said grommets each define a side and an end to end central aperture, said side comprising peripheral outstanding lips spaced by a groove adapted to receive the edge of such header plate, each said grommet defining a lip having in side view rounded outside contours on one side of said groove and substantially rectilinear contours on the other side of said groove.

7. In combination, a radiator core and upper and lower header tanks for assembly thereto wherein:

said radiator core comprises generally parallel open ended tubes and fins extending from said tubes, tube ends extending in each direction beyond the outermost fin, head header tank includes side walls, a core remote wall and a header plate, each said header plate being provided with an array of apertures corresponding to said tubes, and having pairs of longer and shorter side edges, said header plate to said longer side edges integrally extending into side walls, said header plate and integrally extending side walls being welded to the remainder of said header tank, including resilient grommets mounted in said header plate apertures, each said grommet having a central bore receiving a tube end, said grommet aperture and said tube end being selected so that, with said grommets and tubes installed said grommet is in compression to seal both to said header plate and to said tubes.

8. In combination as claimed in claim 7, wherein said grommets each define a side and an end to end central aperture, said side comprising peripheral outstanding lips spaced by a groove adapted to receive the edge of such header plate, each said grommet defining a lip having in side view rounded outside contours on one side of said groove and substantially rectilinear contours on the other side of said groove.

* * * * *